United States Patent [19]

Funatsuki et al.

[11] Patent Number: 4,950,996

[45] Date of Patent: Aug. 21, 1990

[54] METHOD OF AND APPARATUS FOR ADJUSTING IGNITION TIMING BY ROTATING THE CRANKSHAFT WITH THE COIL AND SPARK PLUG TERMINALS DISCONNECTED FROM THE IGNITION CIRCUIT

[75] Inventors: Koji Funatsuki; Shigeru Hiramatsu, both of Hiroshima, Japan

[73] Assignee: Mazda Motor Corporation, Hiroshima, Japan

[21] Appl. No.: 379,789

[22] Filed: Jul. 17, 1989

[30] Foreign Application Priority Data

Jul. 16, 1988 [JP] Japan ..... 63-177783
Jul. 18, 1988 [JP] Japan ..... 63-179492

[51] Int. Cl.[5] ..... F02P 17/00

[52] U.S. Cl. ..... 324/391; 73/116; 324/380; 324/385; 364/431.01

[58] Field of Search ..... 324/391, 392, 385, 386, 324/378, 380; 73/116; 364/431.01, 431.03, 569

[56] References Cited

U.S. PATENT DOCUMENTS 4,186,337 1/1980 Volk et al. ..... 324/380
4,417,469 11/1983 Stevenson et al. ..... 364/431.01 X

*Primary Examiner*—Reinhard J. Eisenzopf
*Assistant Examiner*—Robert W. Mueller
*Attorney, Agent, or Firm*—Fleit, Jacobson, Cohn, Price, Holman & Stern

[57] ABSTRACT

Ignition timing of an internal combustion engine of an automotive vehicle is automatically adjusted by idling the engine with a distributor whose coil terminal and spark plug terminals are disconnected from ignition circuit and detecting an spurious ignition signal for a specified cylinder from the distributor. The distributor is turned with respect to the engine through an angle in accordance with a difference between a rotated angle of the crankshaft of the engine from a detection of the spurious ignition signal to a provision of a top dead center signal and a predetermined angle of the crankshaft for an expected ignition timing.

19 Claims, 17 Drawing Sheets

METHOD OF AND APPARATUS FOR ADJUSTING IGNITION TIMING BY ROTATING THE CRANKSHAFT WITH THE COIL AND SPARK PLUG TERMINALS DISCONNECTED FROM THE IGNITION CIRCUIT

FIELD OF THE INVENTION

The present invention relates to a method of and an apparatus for adjusting ignition timing of an internal combustion engine for an automotive vehicle.

BACKGROUND OF THE INVENTION

Engines, such as internal combustion engines for automotive vehicles, are assembled, partly manually, in an automatic engine assembling line and ignition timing is generally set in a final stage of the engine assembling line. To set up correct ignition timing, the operator practically fires the engine to adjust ignition timing.

Because of this practical firing, it should be performed for operators' safety to cool the fired engine and remove emissions produced by the firing of the engine from the assembling site. Furthermore, because of the adjustment of ignition timing depending upon operator's perception or skill, to set correct ignition timing is a time-consuming operation and is not always performed with a high accuracy.

To avoid the above problems in setting correct ignition timing, it was thought to drive an engine with a distributor by means of a motor connected to the crankshaft of the engine under assembling and to provide a spurious firing signal for number one cylinder of the engine. The distributor is turned and adjusted in timing location with respect to the engine body in such a way as to provide the spurious firing signal at the moment a piston for the number one cylinder nears the top (ordinarily few degrees before TDC) of its compression stroke. The distributor thus adjusted in ignition timing is mechanically tightly fastened or clamped to the engine body. Such an ignition timing adjusting manner is known from Japanese Unexamined Patent Publication No. 56(1981) - 54556.

In any automatic engine assembling line, an automatic step is needed to turn the distributor with respect to the engine body for setting correct ignition timing and tightly fasten the distributor thus adjusted to the engine body. When automatically fastening or clamping the distributor to the engine body by rigidly attaching or fitting a flange of the distributor to the engine body with fastening bolts at several points, a thrust force imparted to the flange of the distributor undesirably lifts up the distributor from the engine body and tends to cause an slight turn of the distributor with respect to the engine body. This leads to the difficulty of fitting the distributor to the engine body without inducing any change of proper engagement between the distributor shaft gear and the engine crankshaft gear and, if in fact the change of proper engagement happens, results in the change of ignition timing and the engine can not fire timely, accordingly.

OBJECT OF THE INVENTION

It is, therefore, an primary object of the present invention to provide a method of and an apparatus for adjusting ignition timing of an internal combustion engine and fastening a distributor to the internal combustion engine thus adjusted without any change in position of the distributor with respect to the internal combustion engine.

SUMMARY OF THE INVENTION

The object of the present invention is achieved by holding down a fitting flange of a distributor against an internal combustion engine while the distributor is being rigidly fastened to the internal combustion engine in an adjusted position to which the distributor is turned with respect to the internal combustion engine so as to make the internal combustion engine to fire at a correct ignition timing.

To detect correct ignition timing, the internal combustion engine, whose coil terminal and spark plug terminals are disconnected from high tension wires, is idled to provide a suprious ignition signal from a distributor for a specified cylinder of the internal combustion engine so as to measure a difference of a rotated angle of a crankshaft of the internal combustion engine in a period from the provision of the suprious ignition signal to when a piston of the specified cylinder reaches to the top dead center of its compression stroke, from a predetermined angle for which the crankshaft is expected to rotate for that period. The distributor is turned with respect to the internal combustion engine through an angle according to the measured difference and, then, fastened to the internal combustion engine in the turned position.

During the fastening of the distributor, the distributor is continuously held down against the internal combustion engine by holding-down clamp means and accordingly prevented from lifting up in a direction in which a distributor shaft extends or changing in position with respect to the internal combustion engine, so that it is fastened to the internal combustion engine with keeping the proper engagement of a camshaft coupled to the crankshaft and the distributor shaft for the correctly adjusted ignition time.

BRIEF DESCRIPTION OF THE DRAWINGS

Still other objects of the invention and more specific features will become apparent to those skilled in the art from the following description of preferred embodiments considered together with the accompanying drawings wherein like reference characters have, been used in the different figures to denote like parts and/in which.

DESCRIPTION OF THE PREFERRED EMBODIMENTS

Figure 1:
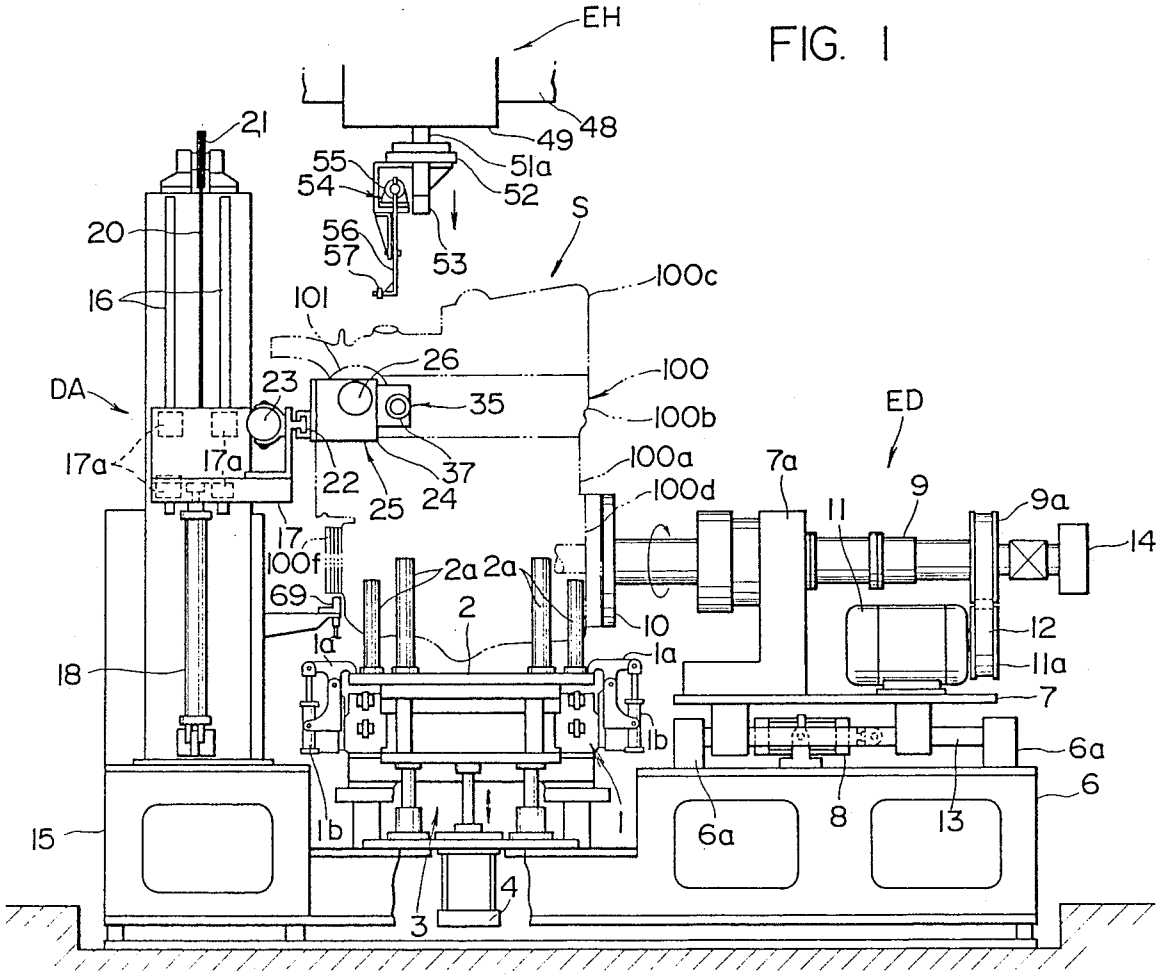
FIG. 1 is a schematic front view showing an ignition timing adjusting apparatus in accordance with a preferred embodiment of the present invention.
Figure 2:
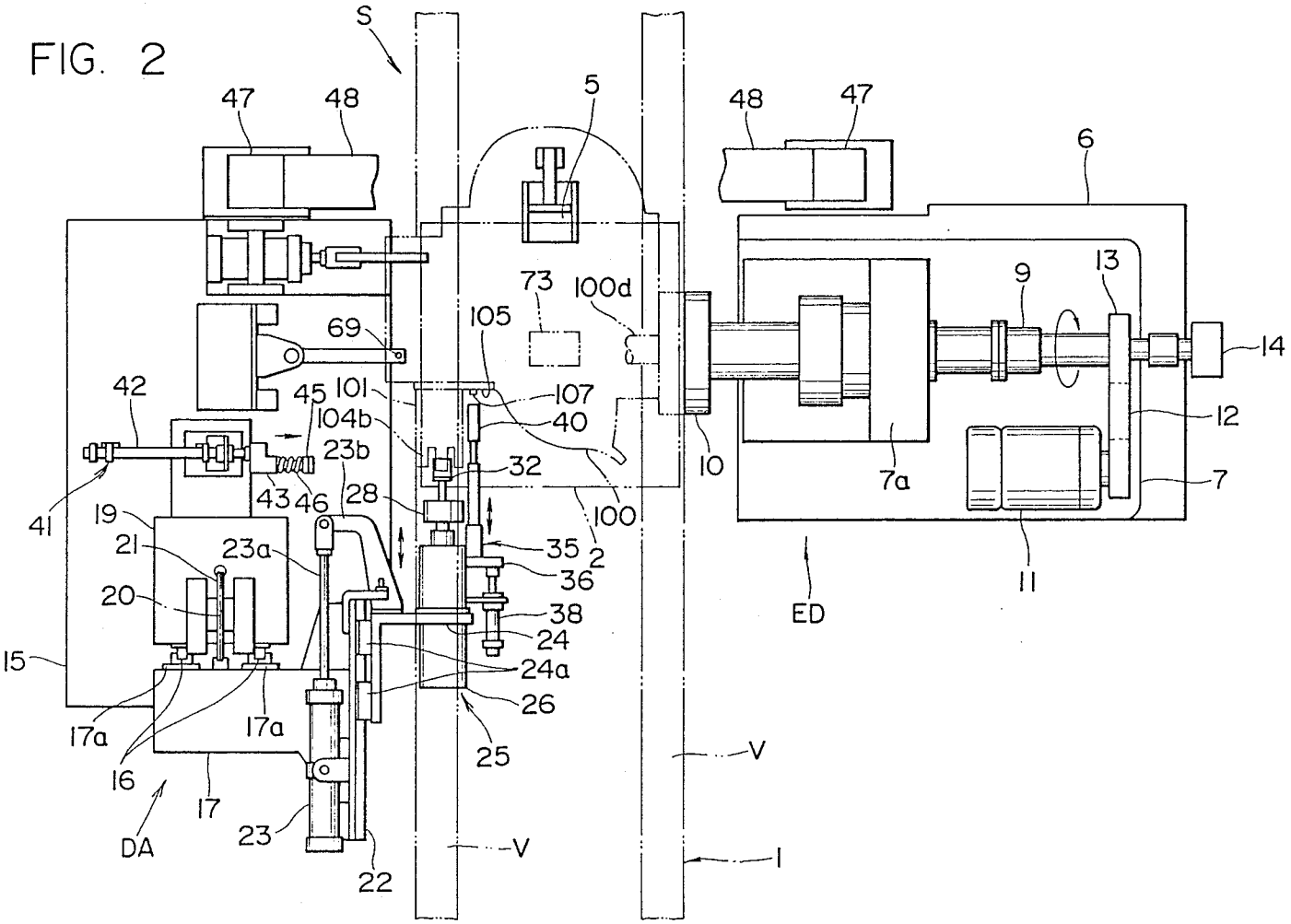
FIG. 2 is a plan view of the ignition timing adjusting apparatus shown in FIG. 1.

Referring to the drawings in detail, particularly to FIGS. 1 and 2, an ignition timing adjusting apparatus in accordance with a preferred embodiment of the present invention is shown, installed in the final station, namely an automatic ignition timing adjusting station S, of an automatic, or partly automatic, engine assembling line including a conveyor system 1. The engine assembling line can take any type well known in the automotive vehicle manufacturing art. The conveyor system 1 intermittently carries pallets 2 toward the ignition timing adjusting station S. Each pallet 2 is firmly fixed to the carrier belts V of the conveyor system 1 by means of clamping arms 1*a* actuated by air-operated cylinders 1*b*.

The pallet 2 bears an internal combustion engine 100 for an automotive vehicle of the type having, for example, four cylinders and an overhead camshaft, firmly held thereon by means of a supporting structure including a plurality of supporting struts 2*a*. The engine, 100, which comprises a cylinder block 100*a*, a cylinder head 100*b* and a cylinder head cover 100*c* which are all well known in structure to those having ordinary skill in the art, and has a distributor 101 temporarily or loosely attached to the cylinder head 100*b* thereof with fastening bolts, is placed on the pallet 2 in such a way as to direct an crankshaft 100*d* in a direction perpendicular to a lengthwise direction in which the pallet 2 is carried and the output end of the crankshaft 100*d* to the right-hand side as viewed in FIG. 1.

Figure 3:
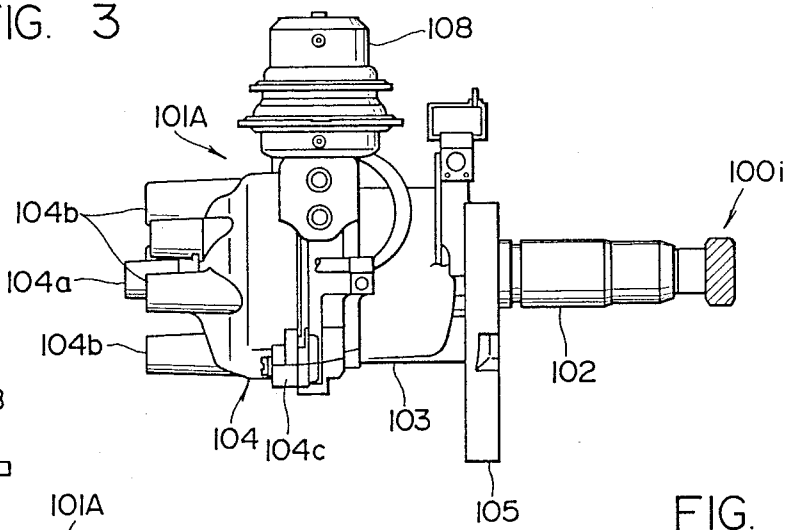
FIG. 3 is a side view showing a boost type distributor used in cooperation with an internal combustion engine which is adjusted in ignition timing by the ignition timing adjusting apparatus shown in FIG. 1.
Figure 5:
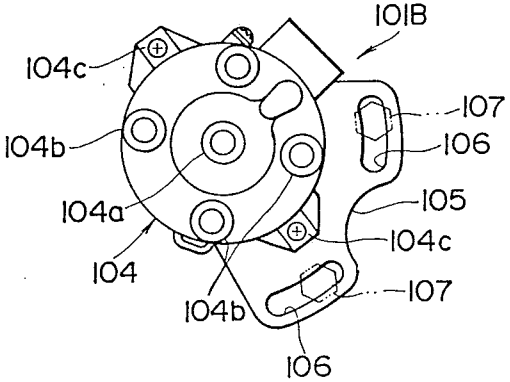
FIG. 5 is a side view showing an IC type distributor used in cooperation with an internal combustion engine which is adjusted in ignition timing by the ignition timing adjusting apparatus shown, in FIG. 1.
Figure 4:
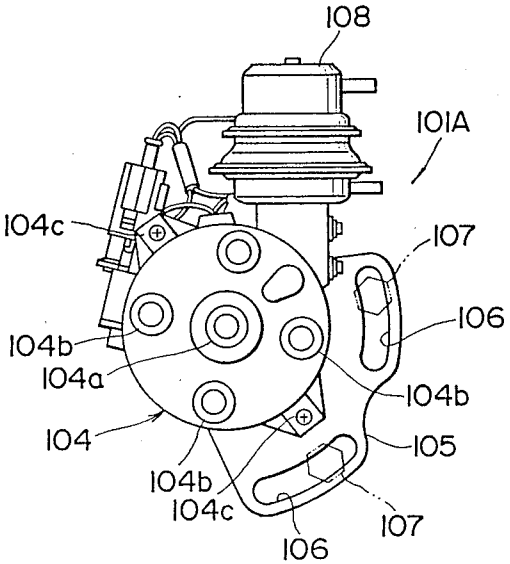
FIG. 4 is a front view of the boost type distributor shown in 3.

As is well known in the art, distributors are generally classified into two types: a boost type distributor 101A illustrated in FIGS. 3 and 4 and an IC type distributor 101B illustrated in FIG. 5. The method of and apparatus for adjusting ignition timing of the present invention is applied to both of the distributors 101A and 101B. These two types of distributors are basically identical in structure with minor differences and selectively used according to engine specifications. Each type of distributor 101A, 101B consists of a cup-like distributor body or housing 103 rotatably mounting a distributor shaft 102 and a distributor cap 104 for closing the open-end of the distributor housing 103. The distributor cap 104 is formed with one center or coil terminal 104*a* and four side or spark plug terminals 104*b*, one per cylinder, arranged in circle at regular angular spacings of 90°, around the coil terminal 104*a*. One of the minor differences of the two types of distributors is that the boost type distributor 101A is designed to have a circular arrangement of the spark plug terminals slightly larger in diameter than that the IC type distributor 101B has. Heavily insulated high tension wire are disconnected from the center terminal 104*a* and all of the spark plug terminals 104*b* so as not to carry high voltage leaving an ignition coil of an ignition system which is well known in structure and operation and need not be shown in the drawings and explained herein.

The distributor housing 103 is formed with an integral sector-like fitting flange 105 which is formed with two slots 106, each forming part of a circle with its center at the axis of rotation of the distributor shaft 102 of the distributor 101. The distributor housing 103 is loosely fastened or bolted to the cylinder head 100*b* with fastening bolts 107 passing through the slots 106. In this manner, the boost type distributor 101A or the IC type distributor 101B is fitted to the cylinder head 100*b* of the engine 100 in a previous assembling station of the engine assembling line. Designated by a reference numeral 108 is a well known vacuum advance unit attached to the boost type distributor 101A only. It is to be noted that the reason the distributor 101 is loosely fitted to the cylinder head 100*b* is that it should be turned with respect to the distributor shaft 102 so as to perform the adjustment of ignition timing in the ignition timing adjusting station S.

The ignition timing adjusting apparatus has a pallet stopper 5 (see FIG. 2) disposed in the ignition timing adjusting station S for stopping the conveyor system 1 upon the front end of the pallet 2 abuts against the pallet stopper 5 so as to locate the pallet 2 accurately. Either upon locating the pallet 2 or upon the completion of the adjustment of ignition time for the engine 100 on the pallet 2, the pallet stopper 1*c* removed away from the pallet 2 in a well known manner. A pallet lifter 3 is disposed in the ignition timing adjusting station S below the conveyor system 1, including an air-operated cylinder 4 for lifting up and down the pallet 2 between the conveyor system 1 and a position at a predetermined height from the conveyor system 1 where the distributor 101 is appropriately subjected to ignition timing adjustment.

Engine idling means ED is provided on a right or first basement 6 of the ignition timing adjusting apparatus installed on one side of the conveyor system 1. The engine idling means ED includes a slidable table 7 mounted on a pair of juxtaposed guide rods 13 supported by supporting blocks 6a of the first basement 6. The slidable table 7 is slid close to and away from the conveyor system 1 by means of an air-operated cylinder 8 mounted on the first basement 6. The slidable table 7 mounts thereon an engine idling motor 11 having an output pulley 11a and an L-shaped bracket 7a. The bracket 7a rotatably supports a rotary shaft 9 having a coupling 10 secured to one end thereof and an input pulley 9a fixedly mounted thereon near the opposite end. The coupling 10 may take any form, such as an electromagnetic coupling. When the pallet 2 is lifted up, the crankshaft 100d of the engine 100 is brought into axial alignment with the rotary shaft 9 so as to be properly coupled to the coupling 10 of the rotary shaft 9. The engine idling motor 11 and the rotary shaft 9 are coupled together by means of a timing belt 12 stretched between the motor output and rotary shaft input pulleys 11a and 9 thereof, whereby connecting the rotation of the engine idling motor 11 transmitted from the output shaft 11a to the rotary shaft 9, so as to rotate the crankshaft 100d of the engine 100 in a predetermined direction at a constant speed, whereby idling the engine.

A rotary encoder 14 is attached to the other or outer end of the rotary shaft 9 and detects a rotated angle of the rotary shaft 9 in a well known manner in the art. This rotary encoder 14 is designed to generate 1440 electric pulses every full revolution of the rotary shaft 9, namely on a frequency of 0.25° rotational angular.

Distributor adjusting means DA is provided on a left or second basement 15 of the ignition timing adjusting apparatus installed on the other side of the conveyor system 1 opposite to the one side on which the first basement 6 is installed. The second basement 15 is provided with a pair of vertically extending guide rails 16. A lift table 17 is slidably supported for vertical movement by means of two pair of guide shoes 17a secured thereto and slidably engaged with a pair of vertically extending guide rails 16. The lift table 17 is forced up and down by means of an air-operated cylinder 17a disposed between the lift table 17 and the second basement 15. For smooth and gentle vertical movement, the lift table 17 is suspended by a wire rope 20 which has a balancing weight 19 attached to one end thereof and is hung on a guide pulley 21 at the top of the second basement 15.

The lift table 17 is provided with a guide rail 22 horizontally extending in parallel with the lengthwise direction in which the pallet 2 is carried. The guide rail 22 slidably mounts thereon a pair of guide shoes 24a secured to an L-shaped bracket 24. The lift table 17 mounts thereon an air-operated cylinder 23 having a piston 23a connected to the L-shaped bracket 24 by means of a connecting arm 23b. The L-shaped bracket 24 firmly holds the distributor adjusting means DA consisting of a distributor driving head 25 and a distributor fastening head 35 disposed side by side which will be described in detail later in association with FIG. 6. When the air-operated cylinder 23 is actuated or deactivated, the L-shaped bracket 24 is moved backwardly or forwardly, respectively.

Figure 6:
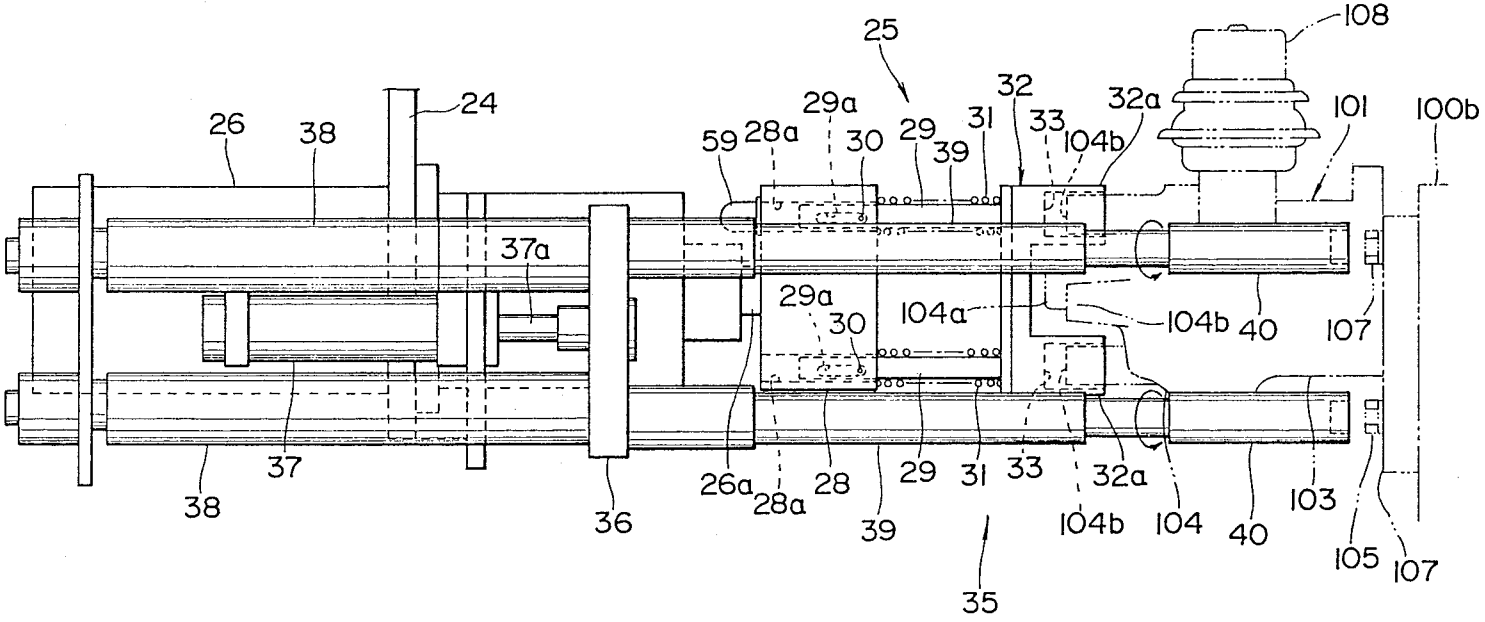
FIG. 6 is an enlarged plan view showing part of distributor adjusting means incorporated in the ignition timing adjusting apparatus shown in FIG. 1.

Referring now to FIG. 6, the distributor driving head 25 and the distributor fastening head 35 of the distributor adjusting means DA are shown in an enlarged scale. The distributor driving head 25, which coacts with the distributor 101 to turn it in one direction for ignition timing adjustment, includes a servo motor 26 of which an output shaft 26a extends in the lengthwise direction in which the pallet 2 is carried. The output shaft 26a is provided at one end thereof with a solid cylindrical supporting block 28 rotatably integral therewith. The supporting block 28 is formed with two through bores 28a extending in an axial direction of the output shaft 26a and disposed symmetrically with the axis of rotation of the output shaft 26a. The axial bores 28a slidably receive therein rear half portions of guide rods 29 secured to a generally U-shaped cap holding socket 32 desirably made of a plastic material. The rear half of each guide rod 29 is formed with an axially extending slot 29a. A fixed stopper pin 30 is slidably received in the slot 29a so as to restrictively define the extremities of axial movement of the each slidable guide rod 29, and hence, of the cap holding socket 32. Coil springs 31 are disposed around the respective guide rods 29 between the supporting block 28 and the cap holding socket 32 so as to usually force the cap holding socket 32 apart from the supporting block 28.

The U-shaped cap holding socket 32 is adapted to fit on two of the four spark plug terminals 104b, symmetrically located with respect to the center terminal 104a, of the distributor cap 104 so as to grasp or hold the distributor cap 104. That is, the U-shaped cap holding socket 32 has socket arms 32a forming a center space therebetween for receiving the coil terminal 104a therein and the socket arms 32a of the U-shaped cap holding socket 32 are formed with axially extending bores 33 capable of snugly fitting on the spark plug terminals 104b of the distributor cap 104.

Referring again to FIGS. 3 and 5, the four spark plug terminals 104 are arranged on a circle with its center at a center of the center terminal 104a. The boost type distributor 101A has a circular arrangement of the spark plug terminals 104b slightly larger in diameter than that the IC type distributor 101B has. For making the cap holding socket 32 commonly available to both of the boost type and the IC type distributor 101A and 101B, the bore 33 of each socket arm 32a consists of an outer half 33a and an inner half 33b overlapping each other so as to have a cocoon-like cross section. The outer halves 33a of the bores 33 of the socket arms 32a of the cap holding socket 32 is so shaped as to snugly fit on the spark plug terminals 104b of the boost type distributor 101A. Similarly, the inner halves 33b of the bores 33 of the socket arms 32a of the cap holding socket 32 so shaped as to snugly fit on the spark plug terminals 104b of the IC type distributor 101B.

When the air-operated cylinder 23 is actuated so as to protrude the piston rod 23a, the distributor driving head 25 mounted on the L-shaped bracket 24 is moved forwardly in the lengthwise direction. The cap holding socket 32 approaches to the distributor cap 104 and brings bores 33 of the socket arms 32a thereof into fitting on the spark plug terminals 104b of the distributor cap 104. After the bores 33 of the socket arms 32a of the cap holding socket 32 fit firmly on the spark plug terminals 104b, the coil springs 31 are compressed so as to prevent an excessive impartment of axial force to the distributor cap 104. Thereafter, the servo motor 26 is actuated to turn the distributor 101 for ignition timing adjustment in a manner as described in detail later.

To detect misfit of the bores 33 of the socket arms 32a of the cap holding socket 32 on the spark plug terminals 104b, an on-off switch 59 is secured to the back surface of the supporting block 28 and is disposed to face one of the through bore 28a of the supporting block 28. When the bores 33 of the socket arms 32*a* of the cap holding socket 32 are not in alignment with the spark plug terminals 104*a* and the socket arms 32*a* of the cap holding socket 32 abut against them when the distributor driving head 25 mounted on the L-shaped bracket 24 moving forwardly, one of the guide rods 29 is forced backwardly and pushes the on-off switch 59 so as to turn it on. If in fact the on-off switch 59 turns on, it provides an electric signal for deactuating the air-operated cylinder 23 so as to retract the piston rod 23*a*, whereby turning back the distributor driving head 25 and, thereafter, actuates again the same.

The distributor fastening head 35, which is a nut runner well known in the art, includes an air-operated cylinder 37 held by part of the supporting bracket 24 and a pair of driving motors 38 supported by a bracket 36 secured to the top end of a piston rod 37*a* of the air-operated cylinder 37. Each driving motor 38 has an output shaft 36*a* having at its outer end a sockets 40 capable of fitting on heads of the fastening bolts 107 loosely tightened. When the air-operated cylinder 37 is actuated so as to protrude the piston rod 37*a*, the pair of driving motors 38 are moved forwardly in the lengthwise direction. The sockets 40 approaches to the fastening bolts 107 and fits on them. After the fitting of the sockets 40 on the heads of the fastening bolts 107, the driving motors 38 are actuated to rotate in synchronism with each other so as to turn the sockets 40, whereby tightening the fastening bolts 107 to firmly rigidly clamp or fasten the distributor 101 to the cylinder head 100*b* of the engine 100.

Figure 8:
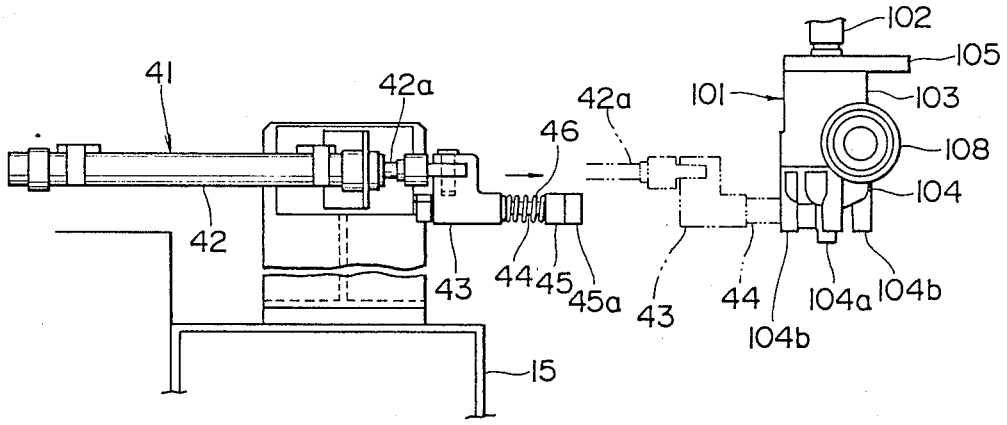
FIG. 8 is an enlarged front view showing a positioning means incorporated in the ignition timing adjusting apparatus shown in FIG. 1.
Figure 9:
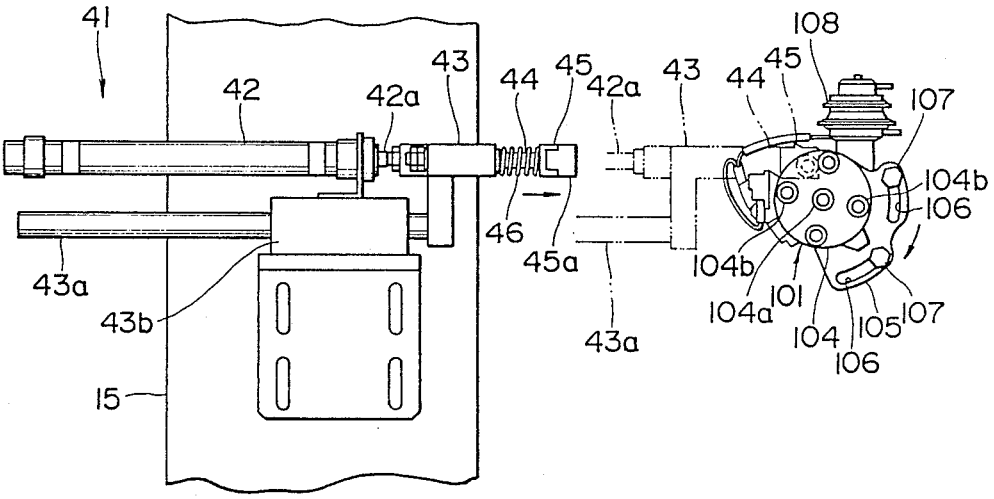
FIG. 9 is a plan view of the positioning means shown in FIG. 8.

A distributor positioning head 41 is disposed on the second basement 15 behind the distributor adjusting means DA for moving or turning the distributor 101 to an extreme position where ignition timing is most retarded. It is noted that the distributor 101 should be, in this embodiment, turned in the clockwise direction with respect to the engine 100 to retard ignition timing or in the counterclockwise direction with respect to the engine 100 to advance ignition timing. As shown in FIGS. 8 and 9, the distributor positioning head 41 includes an air-operated cylinder 42 attached to a frame 39 vertically extending from the second basement 15. A piston rod 42*a* of the air-operated cylinder 42, which protrudes and retracts in a direction in which the carrier belts V move and the pallet 2 is carried, has a fixed mounting block 43 attached to the outer end of the piston rod 42*a* for slidably mounting a shaft 44 laterally displaced from and in parallel with the piston rod 42*a*. The mounting block 43 is connected to an end of a guide rod 43*a* slidably mounted on a guide block 43*b* for preventing rotational movement and stiff back and forth movement. The shaft 44 is integrally provided at its end with a U-shaped clip 45 with a rubber pad 45*a* secured thereto. A coil spring 46 is mounted on the shaft 44 between the mounting block 43 and U-shaped clip 45 so as to urge the U-shaped clip 45 in a direction shown by an arrow in FIG. 8 or toward the distributor 101 temporarily loosely attached to the engine 100 on the pallet 2 located in the ignition timing adjusting station S. The rubber pad 45*a* abuts against a specified one of the four spark plug terminals 104*b* of the distributor cap 104 of the distributor 101 and pushes it when the air-operated cylinder 42 is actuated so as to protrude the piston rod 42*a*. As the piston rod 42*a* protrudes gently gradually, the rubber pad 45*a* forces and turns the distributor 101 in the clockwise direction as viewed in FIG. 9 until one end of each circulararcuate slot 106 abuts against the stem of the fastening bolt 107. As a result the distributor 101 is positioned to most retard ignition timing.

Figure 10:
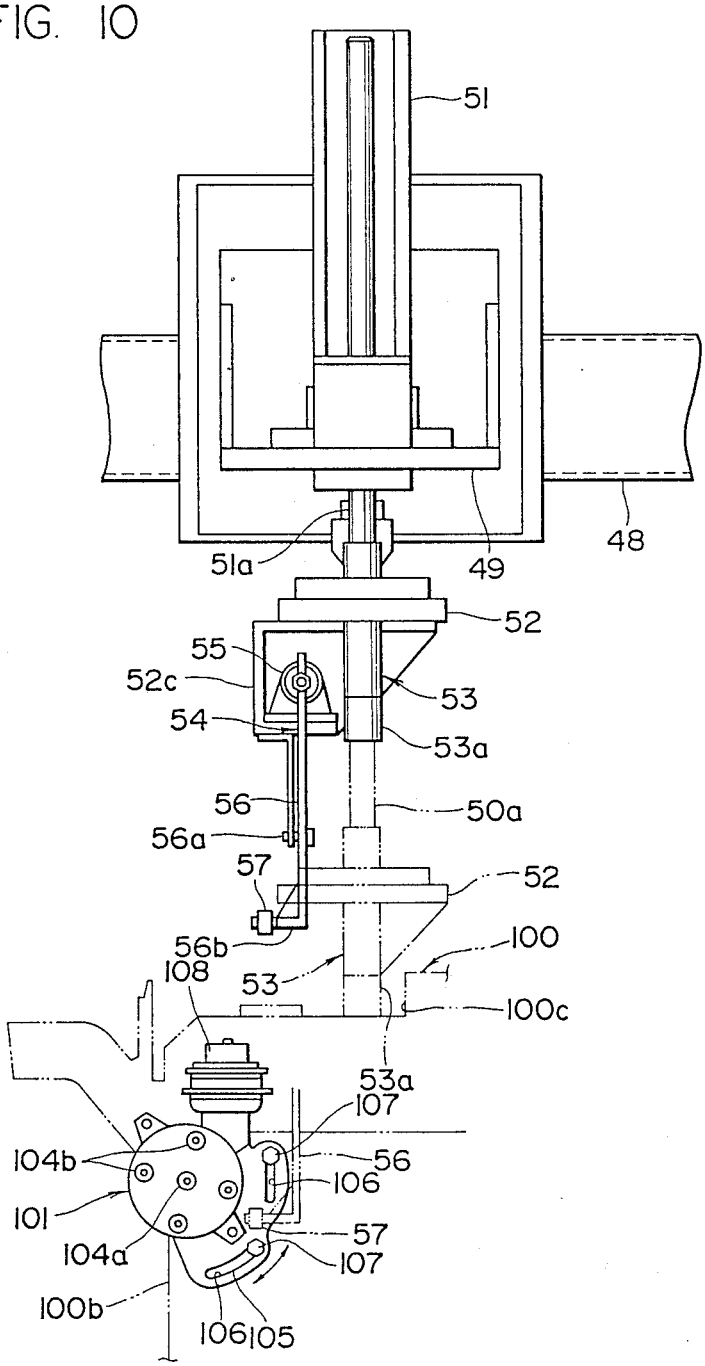
FIG. 10 is an enlarged side view showing engine hold-down camp means incorporated in the ignition timing adjusting apparatus shown in FIG. 1.
Figure 11:
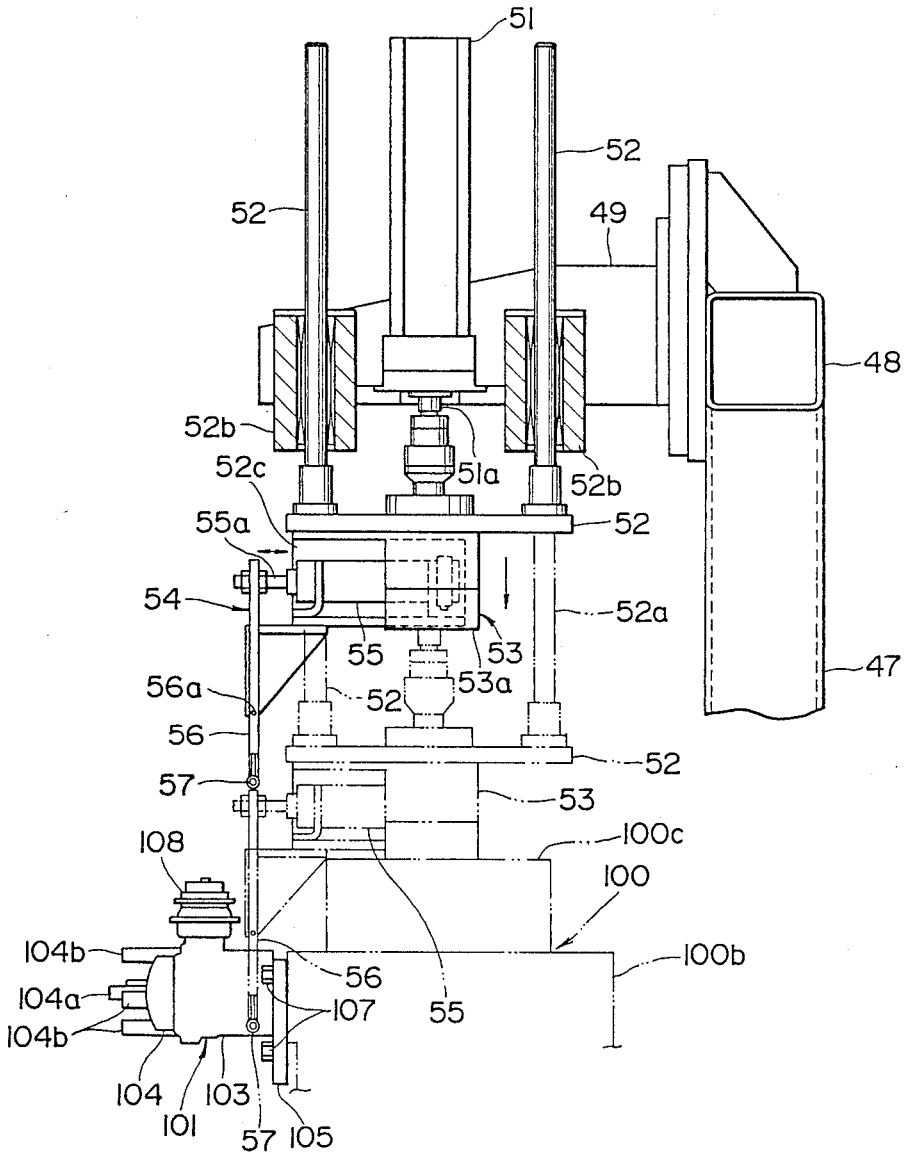
FIG. 11 is an enlarged front view of the engine hold-down camp means shown in FIG. 10.

The ignition timing adjusting apparatus further comprises engine hold-down clamp means EH shown in detail in FIGS. 10 and 11, and is supported by a pair of poles 47 disposed closely after the first and second basements 6 and 15 on both sides of the conveyor system 1. The poles 47 supports a cross beam 48 extending therebetween overhead the conveyor system 1 in a direction perpendicular to the lengthwise direction in which the pallet 2 is carried. The cross beam 48 has a mounting block 49 secured thereto at the middle. The mounting block 49 extends overhead the engine 100 placed on the pallet 2 in the ignition timing station S and mounts thereon an engine hold-down clamp head 50. The engine hold-down clamp head 50 comprises an air-operated cylinder 51 disposed vertically. A piston rod 51*a* extending downwardly from the cylinder 51 has a mounting plate 52 secured to the lower end thereof and having a pair of guide rods 52*a* slidably supported by guide blocks 52*b* secured to the mounting block 49. The mounting plate 52 has a rigid pressure block 53 attached to the under surface thereof, which rigid pressure block 53 has a pressure pad 53*a* made of an elastic material or an elastic plastic material. When the air-operated cylinder 51 is actuated to protrude the piston, rod 51*a* downwardly, the pressure pad 53*a* attached to the rigid pressure block 53 abuts against the cylinder head cover 100*c* of the engine 100 and presses down the engine 100 placed on the pallet 2 in the ignition timing adjusting station S, whereby holding down the engine 100, so as to prevent the engine 100 from changing in position on the pallet 2.

The mounting plate 52 further mounts thereon a distributor hold-down clamp head 54 for holding down the distributor 101 against the engine 100. The distributor hold-down clamp head 54 has an air-operated cylinder 55 connected to the mounting plate 52 by means of a bracket 52*c* secured to the mounting plate 52. A piston rod 55*a* of the cylinder 55, which extends in the lengthwise direction in which the pallet 2 is carried, has a pressure lever 56 pivotally mounted on a pin 56*a* at the middle for pivotal movement in a vertical plane perpendicular to the lengthwise direction in which the pallet 2 is carried. The pressure lever 56 has a lower end arm 56*a* bent at a right angle. A pressure roller 57, which is preferably made of a resiliently or elastically deformable material or a resilient plastic material, is mounted on the lower end arm 56*a* for rotation. The pressure roller 57 is so positioned as to face the flange 105 of the distributor 101 between the circulararcuate slots 106 while the engine 100 placed on the pallet 2 is lifted up in the ignition timing adjusting station S and the air-operated cylinder 51 is actuated to hold down the engine 100 against the pallet 2 with the pressure pad 53*a*. When the air-operated cylinder 55 is actuated to protrude the piston rod 55*a* after the hold-down of the engine 100, the pressure lever 56 turns about the pin 56*a* so as to bring the pressure roller 57 into strongly abutting against the flange 105 of the distributor 101 between the circular-arcuate slots 106, whereby holding down the distributor 101 against the engine 100.

After the sequential actuation of the air-operated cylinders 51 and 55 of the engine hold-down clamp means EH for holding down the engine 100 and the distributor 101, respectively, the air-operated cylinder 42 of the distributor positioning head 41 is actuated so as to turn the distributor 101 toward the most retarded position with respect to the engine 100. Before the fastening of the distributor 101 to the engine 100 is completed, the air-operated cylinders 51 and 55 of the engine hold-down clamp means EH are maintained actuated so as to continuously hold down the engine 100 against the pallet 2 and the distributor 101 against the engine 100, respectively.

Figure 12:
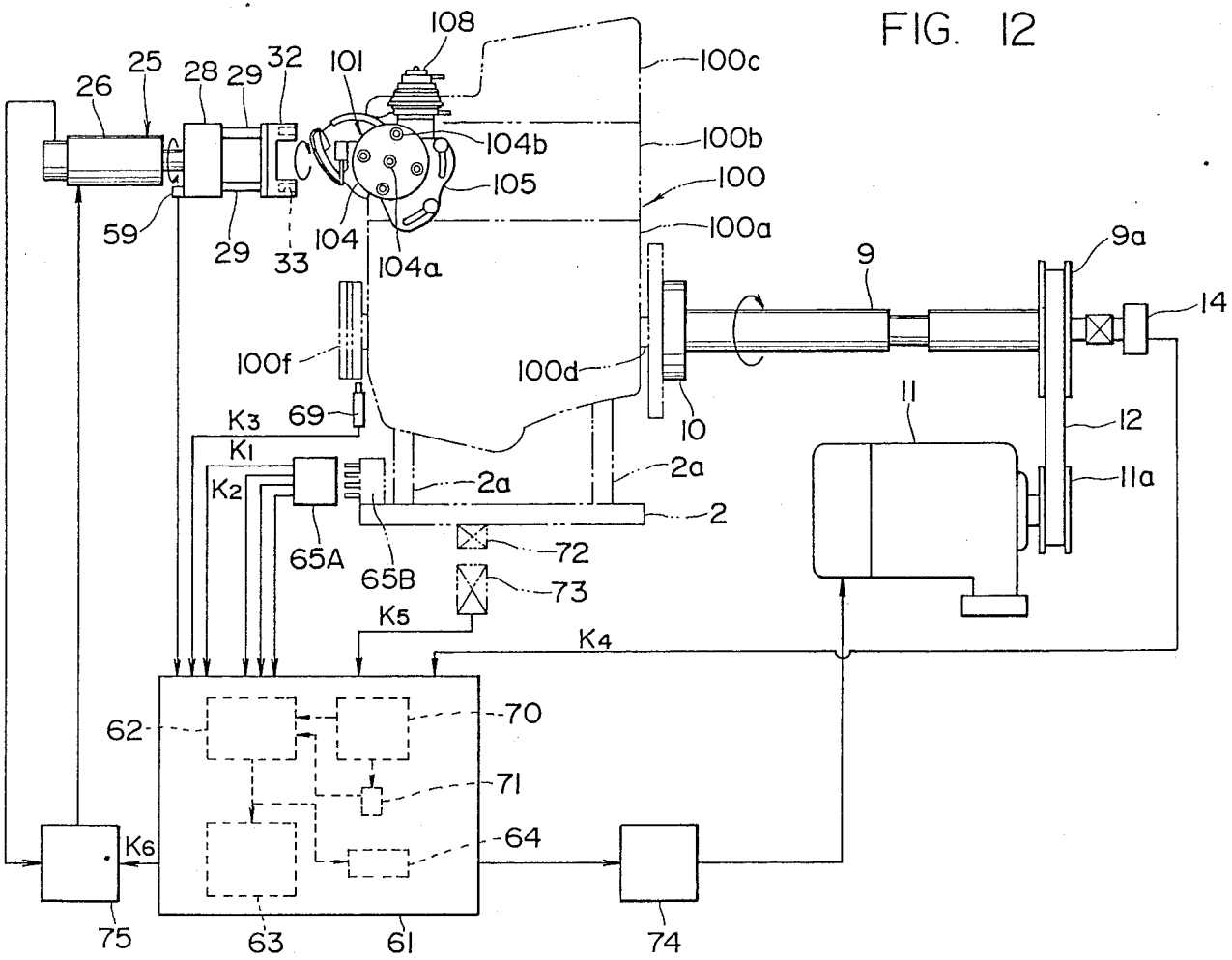
FIG. 12 is a schematic block diagram of an ignition timing adjusting system.
Figure 13:
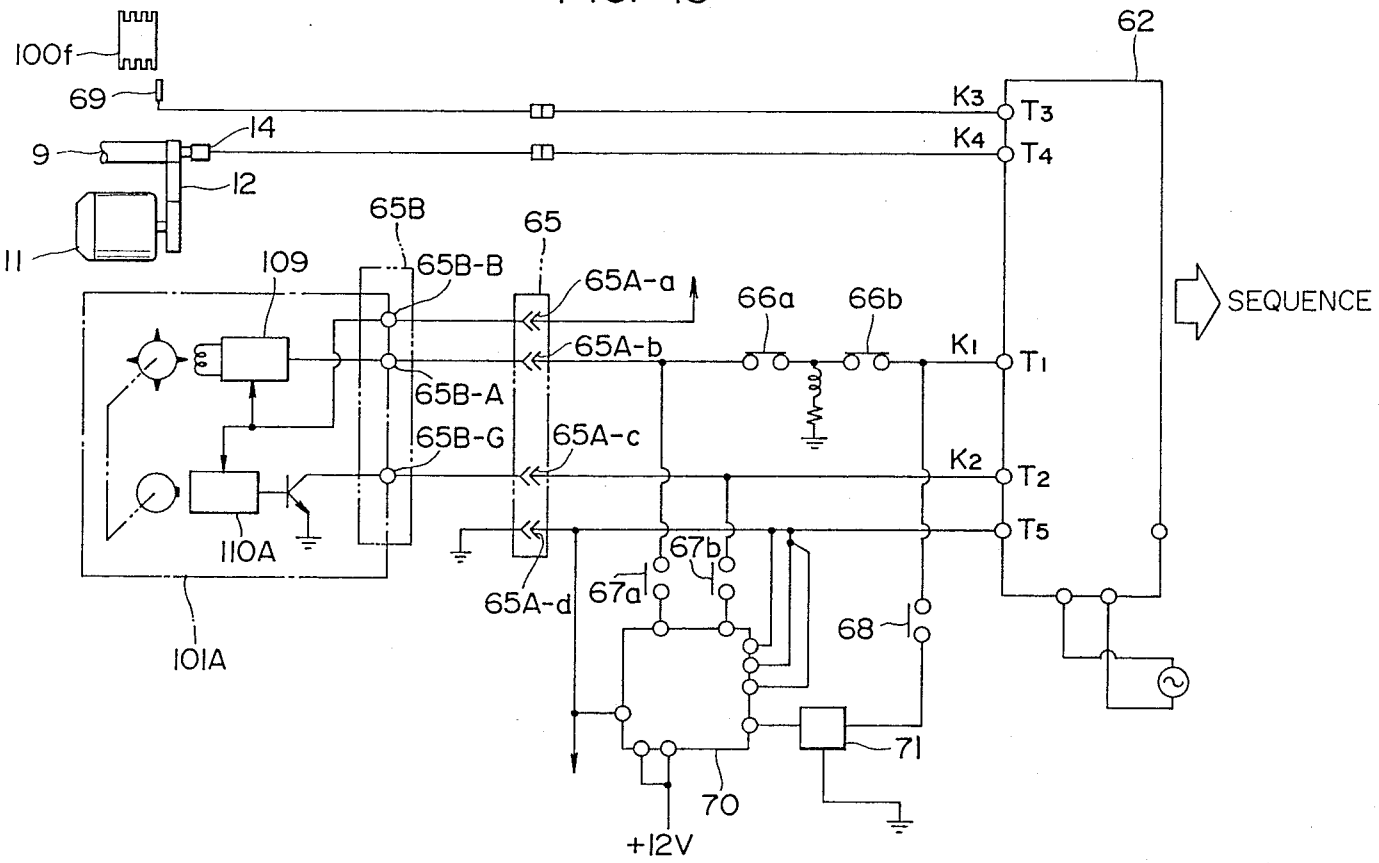
FIG. 13 is a block diagram showing advance angle detecting means of the ignition timing adjusting system in association with the boost type distributor shown in FIG. 3.
Figure 14:
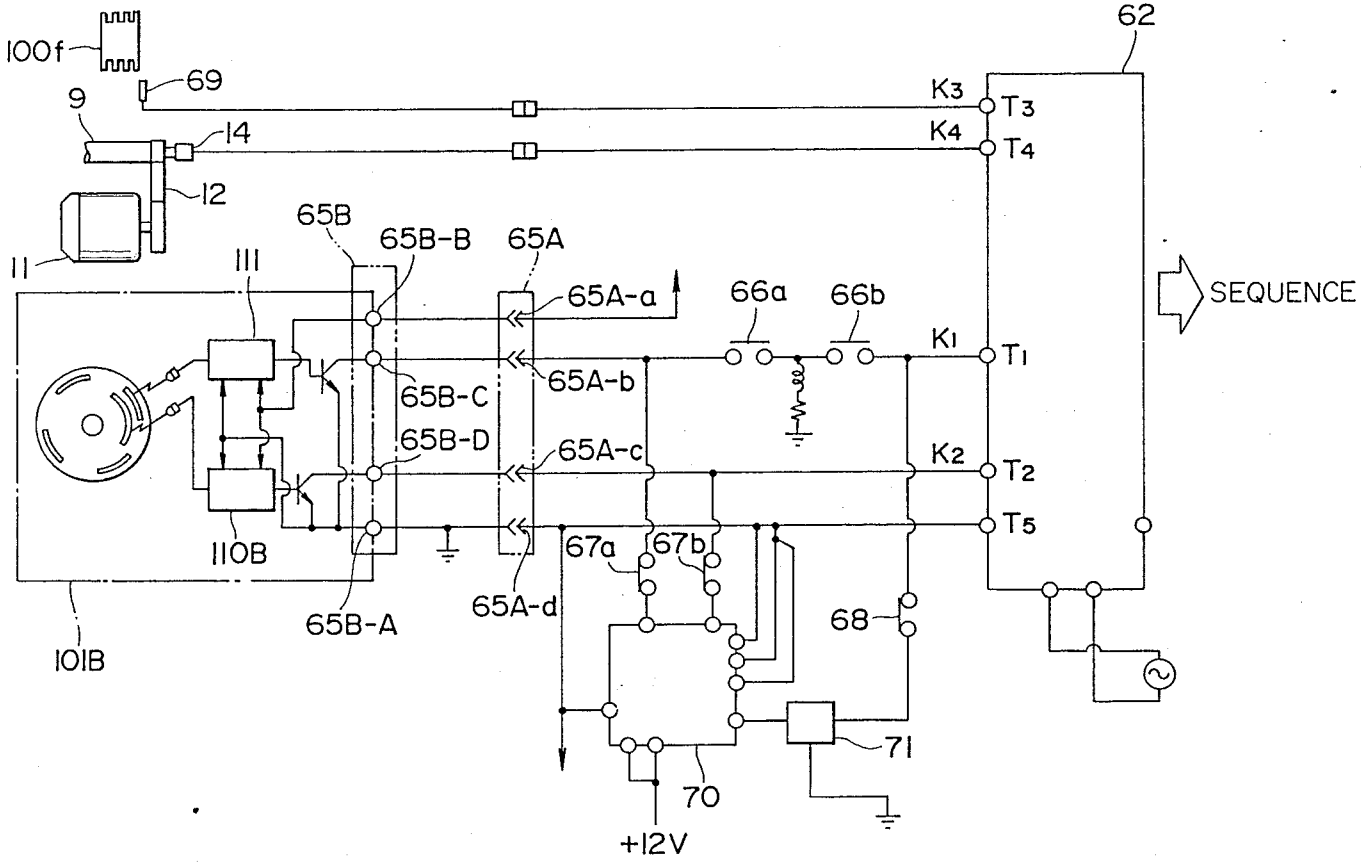
FIG. 14 is a block diagram, similar to FIG. 13, showing advance angle detecting means of the ignition timing adjusting system in association with the IC type distributor shown in FIG. 5.

To adjust ignition timing of the engine placed on the pallet 2, the servo motor 26 of the distributor driving head 25 and the engine idling motor 11 of the engine idling means ED are controlled by means of an ignition timing detector unit 61 and its associated elements as shown in FIGS. 12 and 13 or 14. As shown, the ignition timing detector unit 61 consists of advance angle detector circuit means 62, control circuit means 63 and a digital indicator 64. The ignition timing detector unit 61 includes a connector 65A with a linear arrangement of four connecting terminals **65A-*a* to 65A-*d* which cooperates with a connecting terminal structure 65B attached to the upper surface of the the pallet 2 when the pallet 2** is lifted up in the ignition timing adjusting station S.

As shown in FIG. 13, the connecting terminal structure 65B used for the boost type distributor 101A shown in FIGS. 3 and 4, comprises a connecting terminal 65B-B to be directly connected to an igniter 109 of the boost type distributor 101A which is essentially to be connected to a minus (−) terminal of an ignition coil, a connecting terminal 65B-G to be connected to a cylinder identifying sensor 110A and a power connecting terminal 65B-B through which power is applied to the boost type distributor 101A, in particular to the igniter 109 and the cylinder identifying sensor 110A of the boost type distributor 101A. The igniter 109, which provides a timing signal of ignition, is well known in the art in structure and operation and need not be detailed herein. The cylinder identifying sensor 110 is provided to identify whether or not the timing signal of ignition from the igniter 109 is provided for number one cylinder (No. 1 CY).

On the other hand, as shown in FIG. 14, the connecting terminal structure 65B used for the IC type distributor 101B shown in FIG. 5, comprises a connecting terminal 65B-C to be directly connected to a crank-angle sensor 111 for detecting a turned angle of the crankshaft **100*d* of the engine 100, a connecting terminal 65B-D to be connected to a cylinder identifying sensor 110B, and a power connecting terminal 65B-B through which power is applied to the IC type distributor 101B, in particular to the crank-angle sensor 111 and a cylinder identifying sensor 110B of the of the IC type distributor 101B, and a ground terminal 65B-A through which the IC type distributor 101B** is grounded.

The connecting terminal structure 65B of the distributor 101 is manually attached to the pallet 2 and manually connected to the corresponding terminals **65A-*a* to 65A-*d* at least before the engine 100 placed on the pallet 2** carried into the ignition timing adjusting station S.

The connecting terminal **65A-*a* is connected to a power source of 12V. The connecting terminal 65A-*b* is connected to an ignition signal terminal T1 of the advance angle detector circuit means 62 by means of a first pair of on-off switches 66*a* and 66*b* in series which are simultaneously switched on when the boost type distributor 101A is connected and switched off when the IC type distributor 101B is connected. The connecting terminal 65A-*c* is connected to a cylinder identifying signal terminal T2 of the advance angle detector circuit means 62. The connecting terminal 65A-*d* is connected to a ground terminal T5 of the advance angle detector circuit means 62**.

Figure 15:
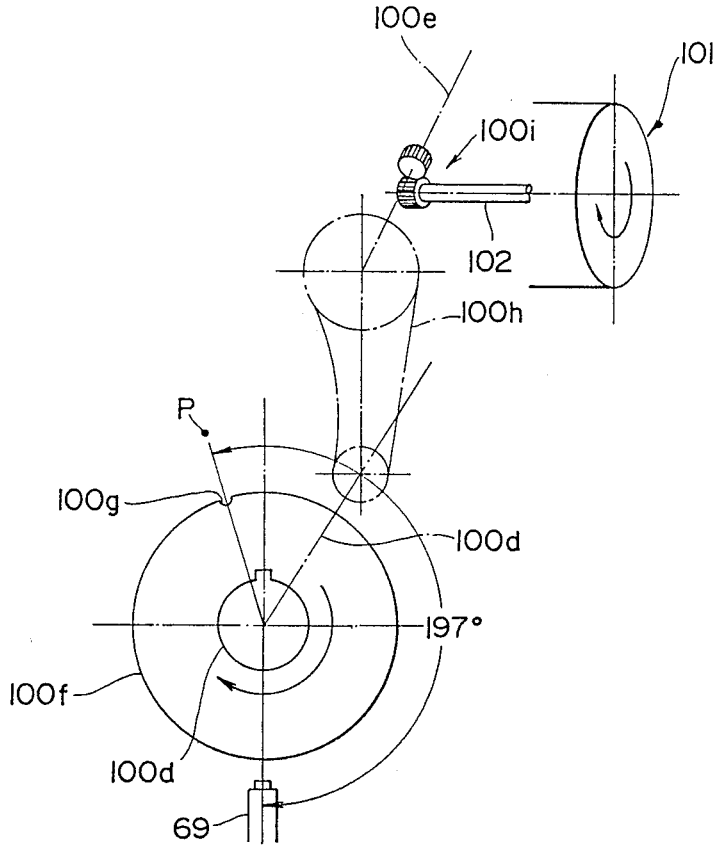
FIG. 15 is an illustration showing a relationship between a crank pulley of an internal combustion engine and a distributor shaft of the distributor fitted to the internal combustion engine.
Figure 16:
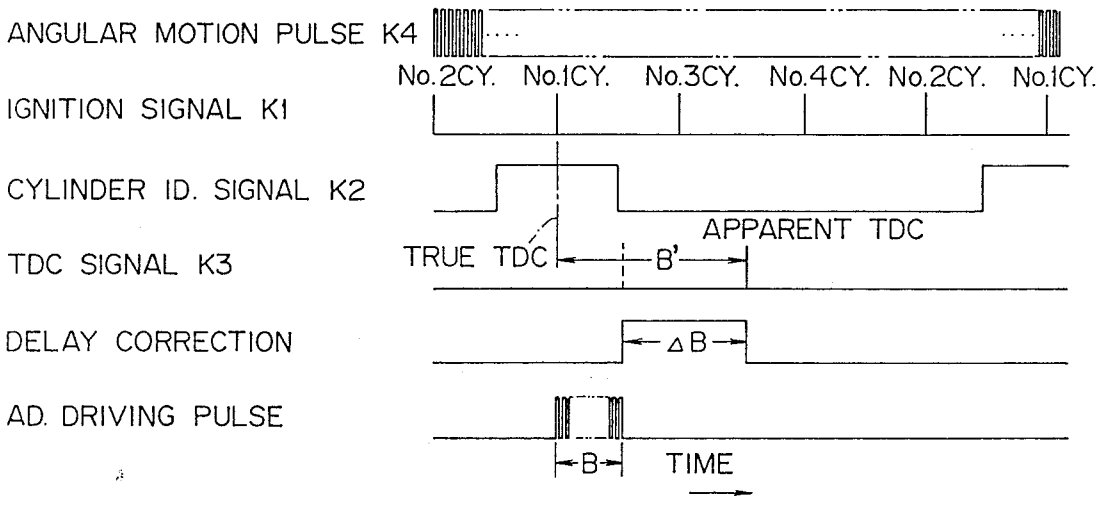
FIG. 16 is a timing chart of various signals necessary to adjust ignition timing.

Connected to the advance angle detector circuit means 62 at terminals T3 and T4 are outputs of a timing mark sensor 69 and the rotary encoder 14. The timing mark sensor 69 is disposed to face the outer periphery of a crank pulley **100*f* secured to the crankshaft 100*d* of the engine 100 so as to detect a timing mark 100*g* applied to or formed on the periphery of the crank pulley 100*f*, whereby deciding whether a piston for number one cylinder is at the top dead center. That is, as shown in FIG. 15, the outer periphery of the crank pulley 100*f* is formed with the timing mark 100*g* in the form of a groove or a notch indicating the timing location of the piston for the number one cylinder. The timing mark sensor 69 is located at a position 197° shifted in a direction of a rotation of the crank pulley 100*f* away from a true TDC position P where the timing mark 100*g* is actually positioned when the piston of the number one cylinder nears the top dead center (TDC), or few degrees before the TDC, of its compression stroke. When the timing mark sensor 69 detects the timing mark 100*g*, it provides an apparent TDC pulse signal K3. The shifted location of the timing mark sensor 69 is corrected in signal processing as will be described later. As is well known in the art, the crankshaft 100*d* is operationally coupled to a camshaft 100*e* by means of a timing chain belt 100*h* and a gear mechanism 100*i* which consists of two helical gears fixed to the camshaft 100*e* and a distributor shaft 102 of the distributor 101. The distributor shaft 102** is adapted to turn at one-half crankshaft speed.

The ignition timing detector unit 61 further has a control unit 70. This control unit 70 is connected to the connecting terminals **65A-*b* and 675A-*c* by means of a second pair of on-off switches 67*a* and 67*b*, respectively, which are simultaneously switched off when the boost type distributor 101A is connected and switched on when the IC type distributor 101B is connected. The control unit 70 is further connected to an igniter 71 connected between the on-off switch 66*b* and the ignition signal terminal T1 of the advance angle detector circuit means 62 through a third on-off switch 68 which is switched off when the boost type distributor 101A is connected and switched on when the IC type distributor 101B is connected. The igniter 71 is the same in structure and operation as the igniter 109 of the boost type distributor 101A**.

To make the measurement of advance angle on ignition timing for the specified cylinder or the number one cylinder, the advance angle detector circuit means 62 is applied with various signals, such as an ignition timing signal K1 output from the connecting terminal 65B-C of the boost type distributor 101A or the igniter 71, a cylinder identifying signal (ID signal) K2 provided from the cylinder specifying sensor 110A or 110B, a TDC (top dead center) signal K3 from the timing mark sensor 69 and angular motion pulses K4 from the rotary encoder 14. The measurement is effected by converting an angle of delay in crank rotation into the number of angular motion pulses K4 output from the rotary encoder 14. Data of the number of angular motion pulses B is input into the controller 63 and converted into a digital signal of advance for ignition timing which in turn is visually displayed on the digital indicator 64.

As shown in FIG. 12, the pallet 2 is provided with an engine type marking 72 in the form of, for example, an optically readable member attached to the under surface thereof for identifying the type of the engine 100 placed on the pallet 2. An optical reader head 73 removably placed below the pallet 2 at the ignition timing adjusting station S reads the engine type marking 72 to provide an engine type signal K5 indicating the type of the engine 100 which in turn is transmitted to the controller 63. Upon the presence of the engine type signal K5, the controller 63 retrieves data of an advance angle in the form of the number of angular motion pulses A and data of an idle speed at which the engine 100 should be idled. Such data are predetermined correspondingly to various types of engines. and previously stored in a memory of the controller. From the numbers of pulses A and B thus obtained, the number of drive pulses C is calculated from B−A=C in the controller 63. The result of this calculation is output as a drive signal K6 from the controller 63 and sent to a servo drive controller 75. The idle speed data is transferred to an inverter 74 for controlling the speed of rotation of the engine idling motor 11 so as to idle the engine 100 at the predetermined idle speed. While the engine 100 is driven at the predetermined idle speed, the servo drive controller 75 drives the servo motor 26 to rotate for an angle of rotation designated by the drive signal K5, whereby turning the distributor 101 in a direction in which ignition timing is advanced.

The operation of the ignition timing adjusting apparatus constructed as above and shown in detail in the drawings will be hereinafter described. The engine 100 with the distributor 101 loosely fastened is placed on the pallet 2 and carried into the ignition timing adjusting station S by the conveyor system 1. The distributor 101 is previously disconnected from all of the insulated wires and the ignition coil of the ignition system. Upon the pallet 2 is located at the ignition timing adjusting station S, the air-operated cylinder 4 of the pallet lifter 3 is actuated so as to lift up the pallet 2 to the predetermined height of the working position. As soon as the pallet 2 reaches the working position, the air-operated cylinder 51 of the engine holding head 50 of the engine hold-down clamp means EH is actuated, forcing the mounting plate 52 downwardly so as to press the cylinder head cover **100*c* with the elastic pressure pad 53*a* of the rigid pressure block 53, whereby holding down the engine 100 against the pallet 2 and preventing it from moving or changing in position on the pallet 2. As the mounting plate 52 comes down, the distributor holding head 54 approaches sideways to the distributor 101 so as to locate the pressure roller 57 of the pressure lever 56 close to the middle portion of the fitting flange 105 of the distributor 101. When the air-actuated cylinder 55 of the distributor holding head 54 is actuated, the piston rod 55*a* protrudes so as to turn the pressure lever 56 about the pin 56*a*, bringing the pressure roller 57 into pressing against the fitting flange 105 of the distributor 101. In this manner, the fitting flange 105 of the distributor 101 is brought into firm contact with the outer surface of the cylinder head 100*b* of the engine 100**.

Thereafter, the air-operated cylinder 8 of the engine idling means ED is actuated, moving the slidable table 7 toward the conveyor system 1 so as to bring the coupling 10 of the rotary shaft 9 into contact with the outer end of the crankshaft **100*d* of the engine 100 and couple them together. Thus, the engine 100 is put ready to be driven by the engine idling motor 11** of the engine idling means ED.

After connecting the connector 65A to the connecting terminal structure 65B of the pallet 2 but prior to effecting the adjustment of ignition timing of the engine 100, the air-operated cylinder 42 of the distributor positioning head 41 is actuated. When the air-operated cylinder 42 of the distributor positioning head 41 is actuated, the piston rod **42*a*, and hence the spring urged shaft 44 slidably mounted on the mounting block 43, are gradually gently moved so as to bring the rubber pad 45*a* of the spring urged shaft 44 into pressing against a specified spark plug terminals 104*b* of the distributor cap 104 of the distributor 101. AS the piston rod 42 is further moved, the spring urged shaft 44 pushes the specified spark plug terminal 104*b* so as to turn the distributor 101 in the clockwise direction until one end of at least one of the circular-arcuate slots 106 of the fitting flange 105 of the distributor 101 abuts against the stem of the fastening bolt 107. After the abutment of the circular-arcuate slot 106 against the fastening bolt stem, the coil spring 46 is compressed so as not to impart an excessive force to the specified spark plug terminal 104*b*, and hence the fastening bolts 107. While or after the actuation of the air-operated cylinder 42 of the distributor positioning head 41, the air-operated cylinder 23 is actuated, retracting the piston rod 23*a* so as to move forwardly the distributor driving head 25 and the distributor fastening head 35 disposed on the support bracket 24 side by side and to locate them near the distributor 101**.

As soon as the pallet 2 is positioned in the ignition timing adjusting station S and then lifted up, the optical reader head 73 is moved and located below the pallet 2 in a well known manner so as to face the engine type marking 72 previously attached to the under surface of the pallet 2 and reads the engine type marking 72 to output an appropriate engine type signal K5 to the controller 63. Under the presence of the engine type signal K5, the controller 63 changes the conditions of the first to third on-off switches **66*a* to 68. That is, if the optical reader head 73 reads an engine type marking 72 identifying the boost type distributor 101A, the controller 63 causes the first on-off switches 66*a* and 66*b* to switch on, the second and third on-off switches 67*a*, 67*b* and 68 to switch off as shown in FIG. 13. This allows an ignition pulse signal K1 from the igniter 109 of the boost type distributor 101A to be sent to the advance angle detector circuit means 62. On the other hand, if the optical reader head 73 reads an engine type marking 72 identifying the IC type distributor 101B, the first on-off switches 66*a* and 66*b* are switched off and the second and third on-off switches 67*a*, 67*b* and 68 are switched on as shown in FIG. 14. Under the condition of the first to third on-off witches 66*a* to 68, an ignition pulse signal K1 is output from the igniter 71, other than that disposed in the engine 100 under adjustment, which is controlled by the controller 70 of the ignition timing detector unit 61, and sent to the advance angle detector circuit means 62**.

After the above-described preparatory operations, the engine idling motor 11 is started to idle the engine 100 at the predetermined idle speed. As the engine 100 operates, the advance angle detector circuit means 62 is applied with an ignition pulse signal K1 from the engine igniter 109 or the outside igniter 71, a cylinder ID signal K2 from the cylinder identifying sensor 110, a TDC signal K3 from the timing mark sensor 69, and angular motion pulses K4 from the rotary encoder 14. The advance angle detector circuit means 62 starts to count the angular motion pulses K4 starting at the reception of the ignition pulse signal K1 for the number one cylinder and stops at the reception of the TDC pulse signal K3. Because the timing mark sensor 69 detects the timing mark 100*g* of the crank pulley 100*f* of the engine 100 at a position 197° shifted in a forward direction of rotation of the crank pulley 100*f* away from the true TDC position P, the number of angular motion pulses (K4) B' counted between the ignition of the engine 100 and the detection of the TDC pulse signal K3 shall be corrected by subtracting the number of pulses ΔB which has been provided from the rotary encoder 14 while the crank pulley 100*f* turns through 197° . As previously noted, because the angular motion pulse K4 is generated at an angular frequency of 0.25° , the number of pulses ΔB for correction is 788 (197/0.25). From this correction, the number of angular motion pulses B having been provided between the ignition of the engine 100 and the arrival of the piston for the number one cylinder at its top dead center TDC is calculated from $B=B'-\Delta B$. Advance angle data indicating the number of angular motion pulses B is sent to the digital indicator 64, as well as to the controller 63, so as to display a visual indication of the advance angle to be adjusted. It is apparent that if the timing mark sensor 69 can be located at the true TDC position P, no correction is needed.

The controller 63 compares the data of the predetermined advance angle and the data of the actually advanced angle indicating the number of pulses A correspondingly predetermined to the identified type of engine which is retrieved from the memory upon the reception of the engine type signal K5 and calculates the number of drive pulses C from $B-A=C$. The resultant number of drive pulses C is sent as an advance angle adjusting signal K6 to the servo driver 75.

Simultaneously with sending the advance angle adjusting signal K6 to the servo driver 75, the air-operated cylinder 23 is actuated, protruding the piston rod 23*a* so as to move the distributor driving head 25 and the distributor fastening head 35 toward the distributor 101. As the piston rod 23*a* gently protrudes so as to bring the cap holding socket 32 of the distributor driving head 25 into snugly fitting on the specified spark plug terminals 104*b* of the distributor cap 104. For preventing the spark plug terminals 104*b* from receiving an excessive thrust force, the coil springs 31 mounted on the guide rods 29 between the supporting block 28 and the cap holding socket 32 are compressed to absorb the excessive thrust force. In this manner the output transmitted from the servo motor 26 is connected to the distributor cap 104 of the distributor 101, turning the distributor 101.

As was previously noted, because of the cap holding socket 32 of the distributor driving head 25 having the socket arms 32*a* formed with the cocoon-like bores 33, the cap holding socket 32 is available for any type of distributor 101. That is, the cap holding socket 32 is coupled to the distributor cap 104 either through the fitting of the outer halves 33*a* of the cocoon-like bores 33 on the spark plug terminals 104*b* when the boost type distributor 101A is on the pallet 2 or through the fitting of the inner halves 33*b* of the cocoon-like bores 33 on the spark plug terminals 104*b* when the IC type distributor 101B is on the pallet 2.

Because of the distributor 101 at the most retarded position, the fitting of the cocoon-like bores 33 on the spark plug terminals 104*b* of the distributor 101 can be smoothly, securely effected by starting the servo motor 26 from a fixed rotational position. However, if in fact the cap holding socket 32 fails to fit or unsuccessfully fit on the spark plug terminals 104*b* of the distributor 101, the on-off switch 59 at the end of the supporting block 28 is switched on by the slide guide rod 39 to stop the servo motor 26, whereby preventing the cap holding socket 32 from turning the distributor 101 without the proper fitting of the cap holding socket 32 on the spark plug terminals 104*b* of the distributor cap 104.

Figure 7:
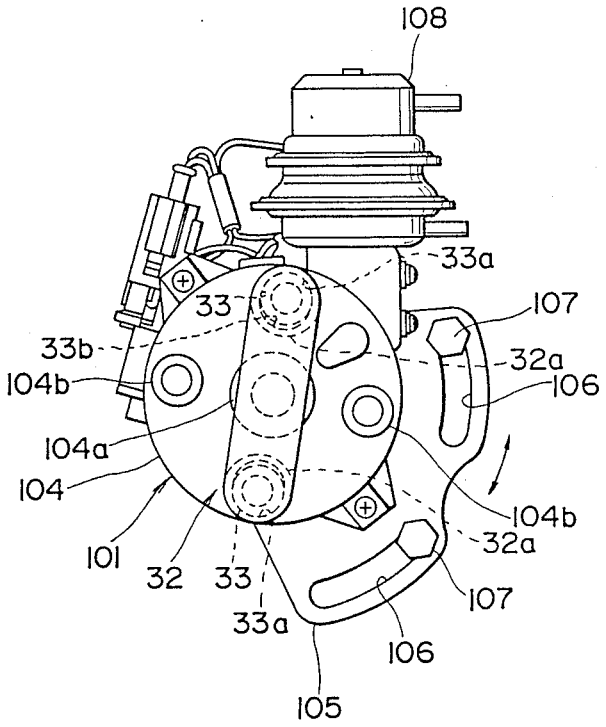
FIG. 7 is a front view showing a socket of a distributor holding head of the distributor adjusting means shown in FIG. 6.

When the cap holding socket 32 snugly fits on the the spark plug terminals 104*b*, the servo driver 75 drives the servo motor 26 for a rotational angle corresponding to the number of drive pulses C which are generated corresponding to the advance angle adjusting signal K6 applied thereto, whereby turning the distributor 101 in the counterclockwise direction as viewed in FIG. 7 from the most retarded position so as to advance ignition timing. It is more favorable to conduct feedback control between the servo motor 26 and the servo driver 75 for more accurate advance angle adjustment. Upon the completion of advance angle adjustment for the engine 100 with the distributor 101 in this manner, the air-operated cylinder 37 is actuated, moving gently the distributor fastening head 35 toward the distributor 101 of the engine 100 so as to fit the sockets 40 on the heads of the fastening bolts 107. Then, the driving motors 38 are simultaneously started to quickly rotate the sockets 40, whereby tightening the bolts 107 to fasten or clamp the distributor 101 thus adjusted in advance angle firmly to the cylinder head 100*b* of the engine 100.

Because the distributor holding head 54 continuously holds down the flange 105 of the distributor 101 against the cylinder head 100*b* by means of the pressure roller 57 so as not to cause any lifting or floating of the fitting flange 105 of the distributor 101 from the cylinder head 100*b* while the distributor driving head 25 drives the distributor 101 and, then, the distributor fastening head 35 tightens the fastening bolts 107, the distributor 101 is accurately fastened or clamped to the cylinder head 100*b* of the engine 100 without any change in position of the distributor 101 against the engine 100. This results in keeping the proper engagement of the gear mechanism 100*i* disposed between the camshaft 100*e* coupled to the crankshaft 100*d* by the chain belt 100*h* and the distributor shaft 102 of the distributor 101, so that no change is caused between the camshaft 100*e* coupled to the crankshaft 100*d* and the distributor shaft 102 and, therefore, the as-adjusted ignition timing of the engine 100 is accurately, securely maintained.

Because of the pressure roller 57 at the lower end of the pressure lever 56 of the distributor holding head 54 pressing the fitting flange 105 of the distributor 101 against the cylinder head 100*b* at the middle between the pair of circular-arcuate slots 106 formed in the fitting flange 105, no lifting or playing of the distributor 101 from the cylinder head 100*b* is caused at all while the distributor driving head 25 drives the distributor 101 and, then, the distributor fastening head 35 tightens the fastening bolts 107.

Furthermore, because of the pressure roller 57 rotatably mounted on the pressure lever 56, the distributor holding head 54 stably holds down the distributor 101 against the cylinder head 100*b* while the the distributor driving head 25 drives the distributor 101, so as not to harm or damage the distributor.

After firmly, rigidly fastening or clamping the distributor 101 to the engine 100, all of the working heads return to their original positions and wait to adjust ignition timing for another engine. On the other hand, the pallet 2 with the engine 100 placed thereon is carried out of the ignition timing adjusting station S.

Referring to FIGS. 17 to 21, there are shown variants of the distributor adjusting means DA which is preferred if it is much favorable not to apply lateral force to the spark plug terminals 104*b* of the distributor cap 104 upon turning the distributor 101 for preventing them from unexpectedly bending or distorting.

Figure 17:
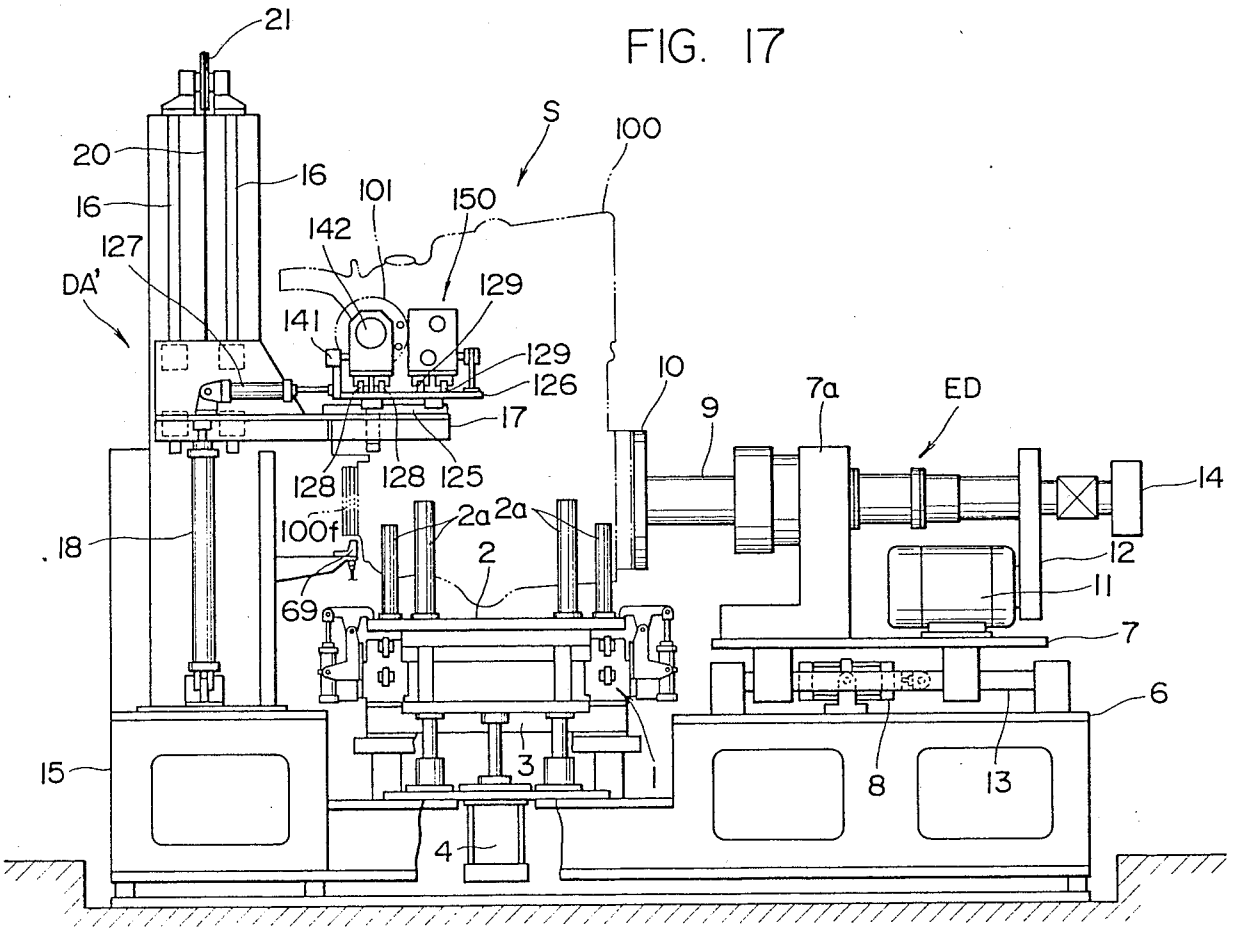
FIG. 17 is a schematic front view showing an ignition timing adjusting apparatus in accordance with another preferred embodiment of the present invention.
Figure 18:
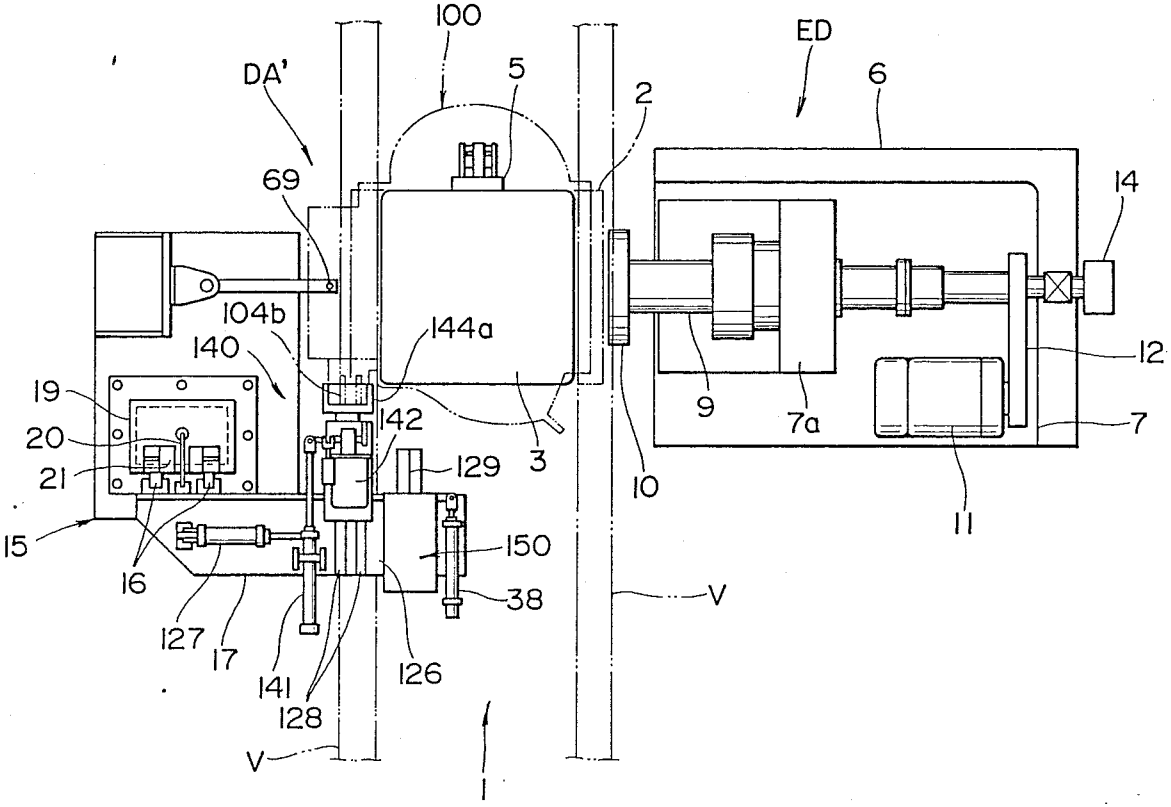
FIG. 18 is a plan view of the ignition timing adjusting apparatus shown in FIG. 17.

As shown in FIGS. 17 and 18, the lift table 17 is provided with a pair of parallel guide rails 125 extending perpendicularly to the lengthwise direction in which the pallet 2 is carried. A mounting table 126 is supported by the guide rails 125 for sliding movement and connected to a piston rod 127*a* of an air-operated cylinder 127 secured to the lift table 17. The mounting table 126 is provided thereon two pairs of parallel guide rails 128 and 129 disposed side by side and extending in parallel with each other in a direction perpendicular to the guide rails 125 or parallel to the lengthwise direction in which the pallet 2 is carried. Distributor adjusting means DA', quite similar in structure and operation to the distributor adjusting means DA of the previous embodiment shown in FIG. 6, including of a distributor driving head 140 and a distributor fastening head 150 is slidably supported by these pairs of parallel guide rails 128 and 129 for back and forth movement. When the air-operated cylinder 127 is actuated to protrude the piston rod 127*a*, the mounting table 126 slides on the guide rails 125, locating the distributor adjusting means DA' so as to face, but away from, the distributor 101 of the engine 100 on the pallet 2 lifted up. On the other hand, when the air-operated cylinder 127 is deactuated to retract the piston rod 127*a*, the mounting table 129 slides back on the guide rails 125, removing the distributor adjusting means DA' laterally away from the engine 100.

Figure 19:
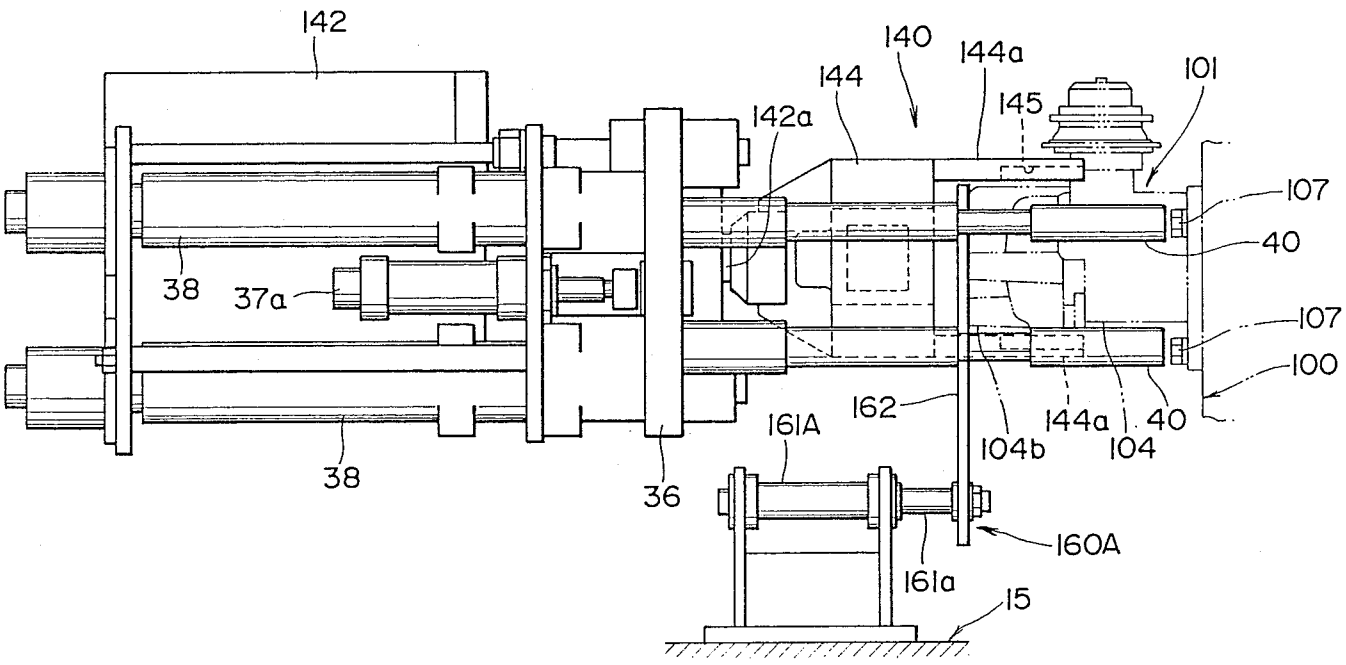
FIG. 19 is an enlarged plan view showing part of distributor adjusting means incorporated in the ignition timing adjusting apparatus shown in FIG. 17.
Figure 20:
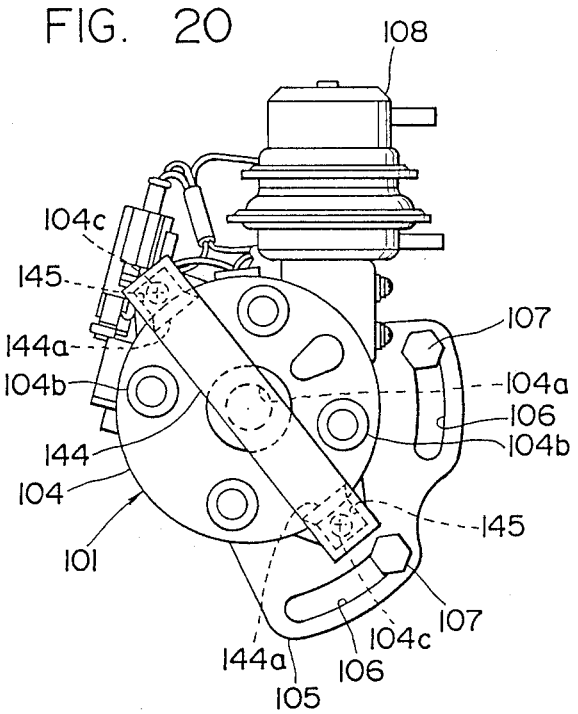
FIG. 20 is a front view showing a clamp chuck of a distributor holding head of the distributor adjusting means shown in FiG. 19.

Referring to FIGS. 19 and 20, the distributor driving head 140 and the distributor fastening head 150 of the distributor adjusting means DA' are shown in detail in an enlarged scale. The distributor driving head 140 has substantially the same structure and operation as the distributor driving head 25 of the previous embodiment excepting a generally U-shaped cup holding chuck 144. The distributor driving head 140 includes a servo motor 142 mounted on the mounting table 126, which is moved close to and away from the distributor 101 by an air-operated cylinder 141, has an output shaft 142*a* fixedly supporting the generally U-shaped cap holding chuck 144 at an outer end thereof. The cap holding chuck 144 is adapted to fit on attaching flanges 104*c* of the distributor cap 104 of the distributor 101 symmetrically located with respect to the coil terminal 104*a* so as to clamp or hold the distributor cap 104. That is, the U-shaped cap holding chuck 144 has chucking arms 144*a* forming a space therebetween for receiving the coil terminal 104*a* therein and the chucking arms 144*a* of the U-shaped cap holding chuck 144 are formed with grooves 145 having a cross section capable of snugly fitting on the attaching flanges 104*c* of the distributor cap 104.

When the air-operated cylinder 141 is actuated so as to protrude the piston rod 141*a*, the distributor driving head 140 mounted is moved forwardly in the lengthwise direction. The cap holding chuck 144 approaches to the distributor cap 104 and brings grooves 145 of the chucking arms 144*a* thereof into snugly fitting on the attaching flanges 104*c* of the distributor cap 104.

The distributor fastening head 150 is completely the same in structure and operation as the distributor fastening head 35 of the previous embodiment and no need be explained herein, accordingly.

In association with the distributor adjusting means DA', a holding head 160A is provided, including an air-operated cylinder 161A which has a piston rod 161*a* horizontally protruding and retracting. The piston rod 161*a* fixedly mounts a pressure plate 162 extending vertically and facing the distributor 101. When the air-operated cylinder 161A is actuated to protrude the piston rod 161*a*, the pressure plate 162 is brought into abutting against top surfaces of the spark plug terminals 104*b* of the distributor 101, whereby holding down the distributor 101 so as to prevent the distributor 101 from being turned after the adjustment of ignition timing while the distributor fastening head 140 tightens the fastening bolts 107.

Figure 21:
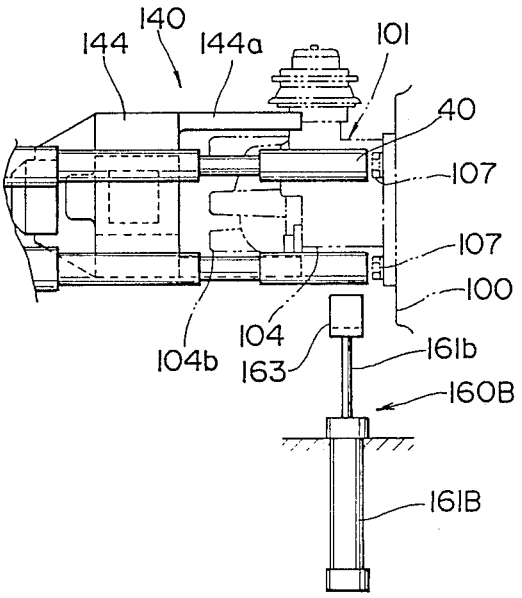
FIG. 21 is an enlarged plan view, similar to FIG. 19, showing a variant of the distributor adjusting means incorporated in the ignition timing adjusting apparatus shown in FIG. 17.

In place of the horizontal type holding head 160A, a vertical type holding head 160B may be emploied as shown in FIG. 21. The vertical type holding head 160B includes an air-operated cylinder 161B which has a piston rod 161*b* vertically protruding and retracting. The piston rod 161*b* fixedly mounts a pressure pad 163 on the top end thereof. When the air-operated cylinder 161B is actuated to protrude the piston rod 161*b*, the pressure pad 163 is brought into abutting laterally against the distributor housing 103 of the distributor 101, whereby holding down the distributor 101 so as to prevent the distributor 101 from being turned after the adjustment of ignition timing while the distributor fastening head 140 tightens the fastening bolts 107.

It should be noted that various changes and modifications are apparent to those skilled in the art which are within the scope of the invention, and such changes and modifications are intended to be covered by the following claims.

What is claimed is:

1. A method of adjusting ignition timing for an internal combustion engine of an automotive vehicle comprising the steps of:

idling said internal combustion engine having a distributor whose coil terminal and spark plug terminals are disconnected from ignition circuit;

detecting an ignition signal for each cylinder of said internal combustion engine provided from said distributor;

detecting an rotated angle of a crankshaft of said internal combustion engine;

providing a top dead center signal at a time a piston of a specified one of said cylinders reaches the top dead center of its compression stroke;

calculating a difference between said detected rotated angle of said crankshaft from a detection of said ignition signal to a provision of said top dead center signal and a predetermined angle for which said crankshaft is expected to rotate; and turning said distributor with respect to said internal combustion engine through an angle according to said difference.

2. An ignition timing adjusting method as defined in claim 1, wherein said ignition signal is provided from an igniter of said distributor and said specified cylinder is identified by a cylinder identifying sensor incorporated in said distributor.

3. An ignition timing adjusting method as defined in claim 1, wherein said ignition signal is obtained from a combination of signals from said distributor identifying sensor and a crankshaft angle sensor for detecting a rotated angle of said crankshaft, both of said distributor identifying sensor and crankshaft angle sensor being incorporated in said distributor.

4. An ignition timing adjusting method as defined in claim 1, wherein said distributor is turned by rotatable means which is pulse-controlled.

5. An ignition timing adjusting method as defined in claim 4, further pressing said distributor against said internal combustion engine so as to be prevented from changing in position at least before turning said distributor with respect to said internal combustion engine according to said difference.

6. An ignition timing adjusting method as defined in claim 5, wherein said distributor is formed with a fitting flange which is pressed against said internal combustion engine so as to prevent said distributor from changing in position and through which said distributor is fastened to said internal combustion engine with fasteners.

7. An ignition timing adjusting method as defined in claim 5, further fixedly fastening said distributor turned through said angle to said internal combustion engine.

8. An ignition timing adjusting method as defined in claim 7, wherein said distributor is formed with a fitting flange through which said distributor is fastened to said internal combustion engine with fasteners.

9. An ignition timing adjusting method as defined in claim 8, further pressing said distributor against said internal combustion engine so as to prevent said internal combustion engine from changing in position at least before turning said distributor with respect to said internal combustion engine according to said difference.

10. An ignition timing adjusting method as defined in claim 1, further turning said distribution to a position where ignition timing of said internal combustion engine is most retarded at least before detecting said ignition signals.

11. An ignition timing adjusting apparatus for adjusting ignition timing for an internal combustion engine of an automotive vehicle comprising:

idling means connected to a crankshaft of said internal combustion engine for idling said internal combustion engine, said internal combustion engine being provided with a distributor loosely fastened thereto whose coil terminal and spark plug terminals are disconnected from an ignition circuit;

ignition timing detecting means for detecting ignition timing for a specified cylinder of said internal combustion engine being idling;

distributor driving means for turning said distributor with respect to said internal combustion engine so as to make said internal combustion engine to fire at said detected timing;

fastening means for rigidly fastening said distributor to said internal combustion engine in said turned position; and holding-down clamp means for holding down a fitting flange of said distributor against said internal combustion engine during said fastening of said distributor.

12. An ignition timing adjusting apparatus as defined in claim 11, wherein ignition timing detecting means for comprising:

an ignition signal sensor for detecting ignition signals for cylinders of said internal combustion engine provided from said distributor;

a cylinder identifying sensor incorporated in said distributor for identifying said cylinders;

a top dead center sensor for detecting a piston of a specified one of said cylinders at the top dead center of its compression stroke;

an angle sensor for detecting an rotated angle of said crankshaft; and control means for calculating a difference between said detected rotated angle of said crankshaft from a detection of said ignition signal for said specified cylinder identified by said cylinder identifying sensor to a detection of said top dead center signal for said piston of said specified cylinder and a predetermined rotating angle for which said crankshaft is expected to rotate and controlling said distributor driving means for turning said distributor with respect to said internal combustion engine based on said difference.

13. An ignition timing adjusting apparatus as defined in claim 11, wherein said distributor is formed with a fitting flange having at least one circular-arcuate fastening slot with its center at an axis of rotation of a distributor shaft, through said slot a fastener being tightened so as to fasten said distributor to said internal combustion engine.

14. An ignition timing adjusting apparatus as defined in claim 13, further comprising positioning means for turning said distributor to a position where one end of said slot abuts against said fastener before said ignition timing detection.

15. An ignition timing adjusting apparatus as defined in claim 11, wherein said distributor turning means includes a distributor cap holding means for holding a distributor cap of said distributor.

16. An ignition timing adjusting apparatus as defined in claim 15, wherein said distributor cap holding means has a socket capable of snugly fitting on spark plug terminals of said ignition cap.

17. An ignition timing adjusting apparatus as defined in claim 15, wherein said distributor cap holding means has a clamping head for grasping fitting flanges formed integrally with said distributor cap through which said distributor cap is fitted to a distributor housing of said distributor with fasteners.

18. An ignition timing adjusting apparatus as defined in claim 11, wherein said distributor driving means and said fastening means are arranged side by side and supported by slidable means for movement between a position facing said distributor and a position away from said distributor.

19. An ignition timing adjusting apparatus for adjusting ignition timing for an internal combustion engine of an automotive vehicle comprising:

ignition timing detecting means for detecting correct ignition timing of said internal combustion engine to provide an ignition timing adjusting signal based on which a distributor without high tension wires attached to said internal combustion engine is adjusted in position with respect to said internal combustion engine;

driving means for turning said distributor with respect to said internal combustion engine through a rotational angle corresponding to said ignition timing adjusting signal so as to adjust said internal combustion engine to fire at said correct ignition timing;

fastening means for rigidly fastening said distributor to said internal combustion engine at said turned position;

shifting means for shifting said driving means and fastening means between a position in front of said distributor and a position away from said distributor; and holding-down clamp means for holding down said distributor against said internal combustion engine after said turning of said distributor so as to prevent said distributor from changing in position during said fastening of said distributor.

* * * * *